US005207032A

United States Patent [19]

Frymier et al.

[11] Patent Number: 5,207,032

[45] Date of Patent: May 4, 1993

[54] ROTARY FINISHING TOOL AND ADAPTER

[75] Inventors: Everett W. Frymier, Avon; Alfred F. Scheider, Orange, both of Ohio

[73] Assignee: Jason, Inc., Cleveland, Ohio

[21] Appl. No.: 855,671

[22] Filed: Mar. 23, 1992

[51] Int. Cl.[5] ..... B24B 55/02

[52] U.S. Cl. ..... 51/267; 51/332; 15/181

[58] Field of Search ..... 51/267, 330, 332, 334, 51/352, 168; 15/181, 179

[56] References Cited

U.S. PATENT DOCUMENTS

| | | | |
|---|---|---|---|
| 190,120 | 5/1877 | Budd | 15/181 |
| 3,109,190 | 11/1963 | Nelson | 51/267 |
| 3,407,425 | 10/1968 | Drumm | 15/181 |
| 3,846,861 | 11/1974 | Smith, Sr. | 15/181 |

FOREIGN PATENT DOCUMENTS

| | | | |
|---|---|---|---|
| 0155165 | 9/1983 | Japan | 51/267 |

*Primary Examiner*—Robert A. Rose
*Attorney, Agent, or Firm*—Renner, Otto, Boisselle & Sklar

[57] ABSTRACT

A machine for finishing eccentric shafts includes a flow-through quick change arbor with axially spaced radial ports. Hollow adapter hubs are spaced along the shaft in register with the ports. Axial spacing is obtained with cylindrical spacers and discs on each side of each hub. A nut on one end of the shaft clamps stacked hubs, discs and spacers together for rotation with the shaft. Each hub supports two side-by-side finishing tools, each of which includes a ring from which the finishing material extends in a radial array. Each hub on its face includes a set of diametrically opposite bayonet slots which interfit with drive lugs on the inside of the rings. The slots extend in both circumferential directions from the axially extending entrant portions with the ends engaging the lugs for rotation in either direction while providing ease of mounting and replacement. The entrant portions on each side of the hub are aligned and connected so that a tool ring may be mounted from either side of the hub. The hub includes radial ports between the rings so that fluid may flow from the shaft through the hub and between the side-by-side tools on the hubs. The sides of the rings of the tools may be provided with indentations to facilitate this flow directly to the tool working face, which in turn provides an improved quality of finish and longer tool life.

14 Claims, 2 Drawing Sheets

ROTARY FINISHING TOOL AND ADAPTER

This invention relates generally as indicated to rotary finishing tool and adapter, and more particularly to quick change flow-through brush arbor for a crankshaft or cam shaft journal finishing machine.

BACKGROUND OF THE INVENTION

In modern automotive plants, engine crankshaft and cam shaft journals are cleaned and polished in rather complex machines which rotate filament brushes or other suitable finishing tools against the journal surfaces while also rotating the crankshaft or cam shaft about the axis of the journals. To accomplish this the filament brushes have relatively large internal diameters and are mounted on rings in turn mounted on discs which are in turn mounted in axially spaced fashion along a rotating hollow shaft. The brushes, rings and discs are each welded to each other and the discs welded to the shaft, each disc being between sets of ports in the shafts to permit coolant or lubricant to flow from the shaft generally toward the working face along the outsides of the brushes or tools. The axial spacing of the tools along the shaft permits the throw or offset portions of the crankshaft to move between the brushes or tools as the shaft is rotated.

There may be several such operations employed on the shaft initially utilizing a more abrasive finishing material such as shown and described in prior Warner et al U.S. Pat. No. 4,882,879, and finally a polishing or surface finishing material to obtain the precise required microfinish.

While these machines work very well for their intended purpose, they are difficult, time consuming and costly to change. In order to change such brushes when fully worn, all or most of the welds need to be removed to disassemble the brushes. This is particularly true if the type, size, or spacing of the tools is changed. This requires welds to be broken and residual welds to be ground off to obtain a smooth surface for assembly of new tools. Once the tools, rings and discs are reassembled they have to be rewelded in place. The welding and grinding which must be done in an oily environment may adversely affect the balance of the shaft and machine as well as block flow passages. The operation requires a skilled welder and assistant, and takes approximately four hours. During this period the machine is down as is the process. Because of the difficulty in changing out the finishing tools, there is a tendency to let the tools run beyond their useful lives. This in turn adversely affects the uniformity and quality of finish.

SUMMARY OF THE INVENTION

A quick change flow-through arbor for crankshaft or cam shaft finishing machines enables the finishing tools such as abrasive brushes, synthetic or other filament brushes or polishing tools or buffs, to be changed quickly without the use of skilled trades, and without affecting the balance of the machine. The machine includes a flow-through arbor with axially spaced radial ports. Hollow adapter hubs are spaced along the shaft in register with the ports. Axial spacing is obtained with cylindrical spacers and discs on each side of each hub. A nut on one end clamps stacked hubs, discs and spacers together for rotation with the shaft. Each hub supports two side-by-side finishing tools, each of which includes a ring from which the finishing material extends in a radial array. Each hub includes a set of diametrically opposite bayonet slots which interfit with drive lugs on the inside of the rings. The slots extend in both circumferential directions from the axially extending entrant portions with the ends engaging the lugs for rotation in either direction. The entrant portions on each side of the hub are aligned and connected so that a tool ring may be mounted from either side of the hub. The hub includes radial ports between the rings so that fluid may flow from the shaft through the hub and between the side-by-side tools on the hubs. The sides of the rings of the tools may be provided with scallops to facilitate this flow directly to the tool working face, which in turn provides an improved quality of finish and longer tool life.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

DETAILED DESCRIPTION OF THE PREFERRED EMBODIMENTS

Figure 1:
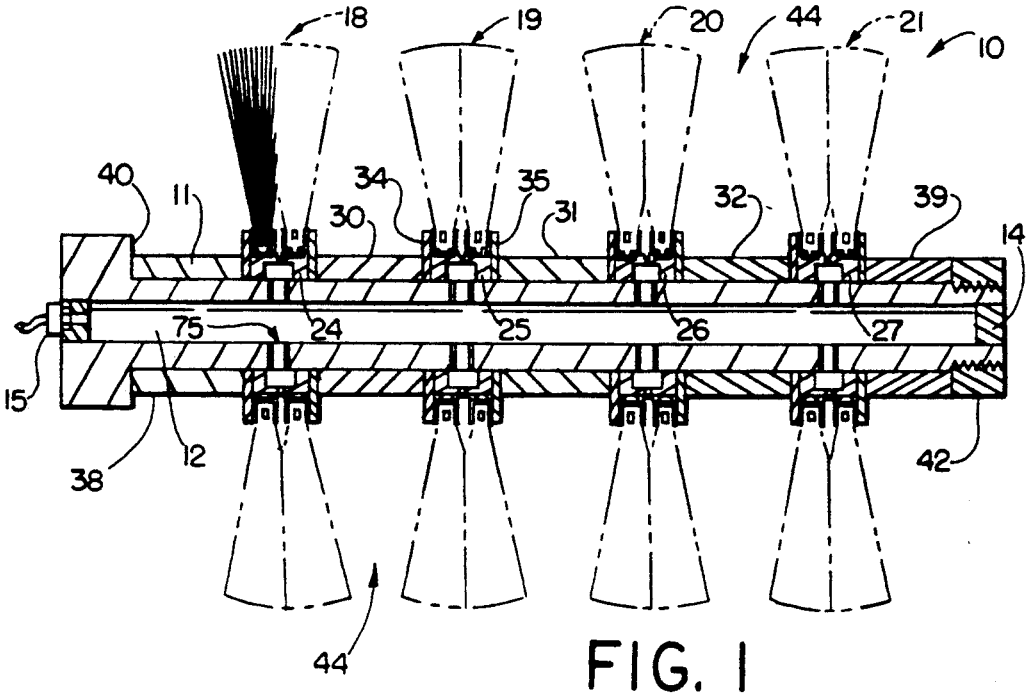
FIG. 1 is an axial section of a quick change flow-through arbor in accordance with the present invention.

Referring now to the drawings and initially to FIG. 1 there is illustrated a flow-through arbor shown generally at 10 which comprises a rotary hollow shaft 11 having an axial passage 12. One end of the passage is sealed by plug 14 while the opposite end is provided with a rotary seal 15 through which coolant or lubricant is provided under pressure to the interior or passage in the arbor.

Mounted in axially spaced fashion along the flow-through arbor 10 are axially spaced sets of finishing tools indicated at 18, 19, 20 and 21. These sets are comprised of side-by-side wheel type rotary finishing tools which may vary from rotary brushes utilizing an aggressive abrasive monofilament such as shown in Warner U.S. Pat. No. 4,882,879 to brushes utilizing synthetic filaments or brushes or buffs using other softer filaments or materials. Each set of rotary wheel type tools is mounted on axially spaced adapter hubs seen at 24, 25, 26 and 27, respectively. Each adapter hub is spaced from the other adapter hubs by intermediate cylindrical spacers seen at 30, 31 and 32 and adjacent each hub interposed between the spacers and the hub are a set of discs of seen at 34 and 35 which extend radially slightly beyond the outside diameter of the hub. At each end of the arbor there are additional spacers seen at 38 and 39. The spacer 38 extends between arbor shoulder 40 and the disc on the side of the first pair of rotary wheel type tools mounted on the arbor 24 while the spacer 39 extends between clamp nut 42 threaded on the end of the arbor and the disc adjacent the pair of wheel type tools 21 on the hub 27. Each of the spacers, discs and hubs have an inside diameter only slightly larger than the outside diameter of the major portion of the arbor and all of the elements illustrated in FIG. 1 may quickly be removed simply by removing the clamp nut 42 and pulling the components from the righthand end of the illustrated arbor. The entire assembly may be reassembled by simply telescoping the components over the arbor and then clamping them down tightly with the nut. The elements are then clamped to each other and to the arbor or shaft for rotation therewith.

It is noted that the axial spacing of the paired tools provides a gap or space therebetween as indicated at 44 which enables the throw or eccentric part of the crankshaft or cam shaft to move therebetween as both the arbor and the shaft being finished rotate.

Referring now additionally to FIGS. 2–5 it will be seen that the hub 27 includes a hollow interior indicated at 46 so that the inside diameter of the hub is actually two axially spaced sections indicated at 47 and 48 separated by the hollow interior. The outside diameter or face indicated at 50 is only slightly smaller than the inside diameters of the rings 52 and 53 while the wheel type finishing tools shown at 54 and 55, respectively, which side-by-side comprise the pair 21. As illustrated, the rings 52 and 53 are channel shape and are clenched around the bight portion of bristles, for example, which extend around a rectangular metal or plastic anchor wire or core as seen at 56 and 57. Each ring is provided with diametrically opposed inwardly directed drive lugs as seen at 60 and 61.

Figure 3:
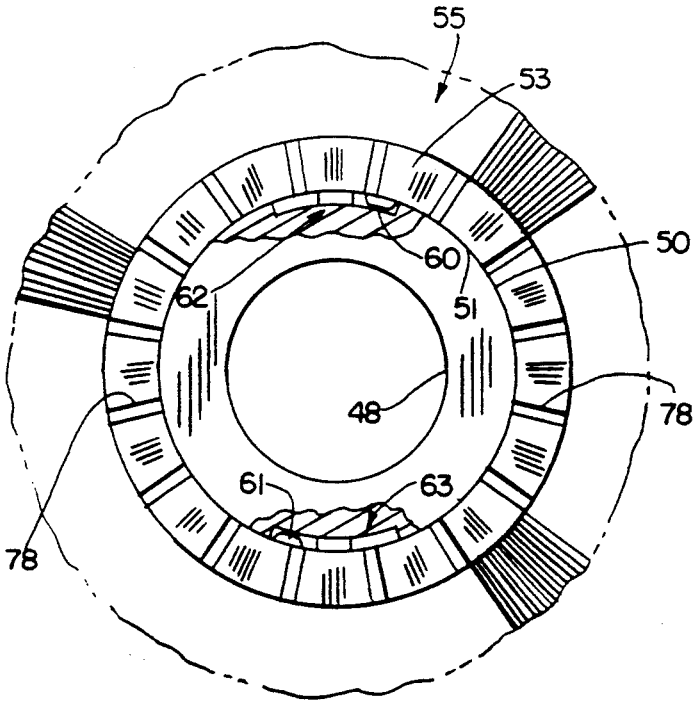
FIG. 3 is an axial end view of such hub partially broken away and in section as seen from the side of FIG. 2.
Figure 2:
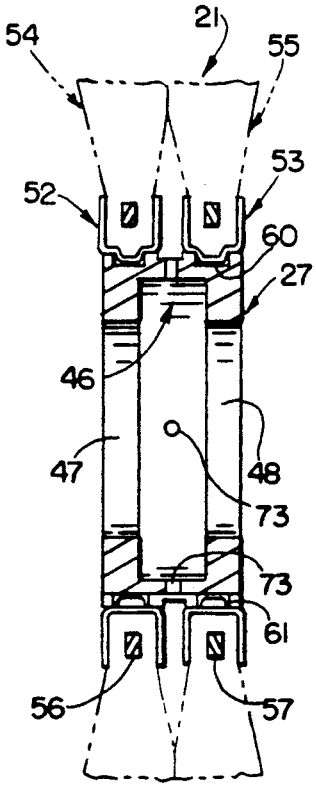
FIG. 2 is an enlarged fragmentary diametral section of the adapter hub with two side-by-side finishing tools mounted thereon.
Figure 4:
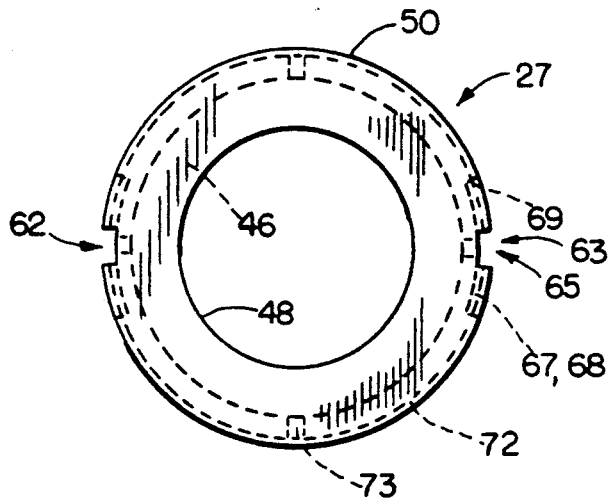
FIG. 4 is an axial end elevation of the hub on a somewhat reduced scale.
Figure 5:
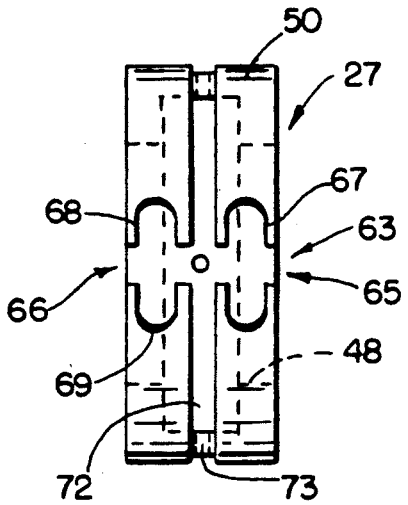
FIG. 5 is an edge elevation of the hub as seen from the right or left hand side of FIG. 4 showing the double T or H-shape configuration of the bayonet face slots.

The drive lugs are designed to interfit with bayonet face slots on the outside diameter of the hub as seen at 62 and 63, respectively. Since the bayonet slots are the same, only the slot illustrated in FIG. 5 will be described in detail. Each slot includes axially opposite entrant portions seen at 65 and 66 which, as is apparent from FIG. 4, form a channel which goes completely across the face of the hub in an axial direction. Intersecting the two entrant portions are parallel circumferential portions seen at 67 and 68 each of which has rounded ends or sockets seen at 69. The sockets 69 at each end of the circumferential slots comprise drive stops which engage the lugs depending upon the direction of rotation. The lug-slot engagement illustrated in FIG. 3 is for counterclockwise rotation as seen in such figure. For clockwise rotation the lug-slot engagement would be at the opposite end of the circumferential slot. It may now be seen that the ring of the wheel tool may readily be inserted on the adapter hub simply by aligning the lug with the entrant portion of the slot then relatively rotating the ring to cause the lug to seat at the desired end of the circumferential section of the slot. As illustrated in FIG. 5 the slots may be termed back-to-back T-slots with the circumferential portions being the head of the T. Because of the through extent of the entrant slots, the ring may be mounted from either axial end of the hub thus giving the slot formation somewhat the configuration of an H.

The outside diameter of the hub between the circumferential slots is provided with an annular groove indicated at 72 and four quadrant spaced radial ports seen at 73 are provided from the hollow interior of the hub to the exterior through the groove 72.

In addition to the ports 73, the arbor 11 is also provided with radial ports for each adapter hub as indicated at 75 in FIG. 1 so that fluid entering through the rotary union flows outwardly through such ports 75, into the hollow interior 46 of each adapter hub, and radially outwardly through the ports 73 between the side-by-side finishing tools mounted on the hub. To facilitate the flow of fluid between the finishing tools the side walls of the rings may be scalloped or indented as seen at 78 in FIG. 3. This provides unobstructed fluid flow between the side-by-side wheel type tool sections ensuring that the coolant or lubricant moves radially directly to the working face of the tools and the journal surface being finished.

Figure 6:
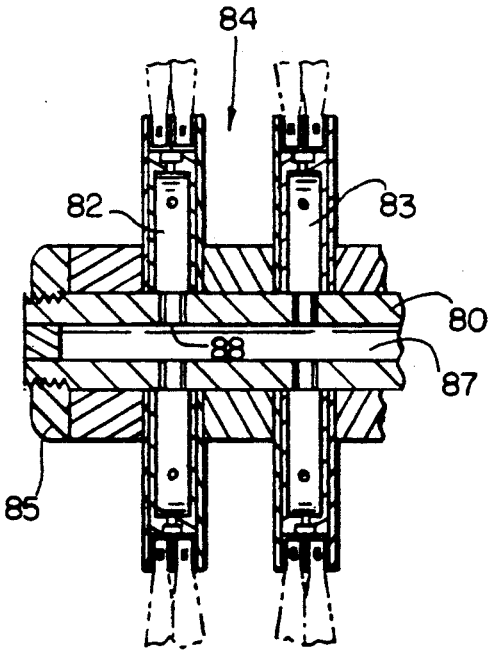
FIG. 6 is a fragmentary view similar to FIG. 1 but showing a somewhat larger diameter hub.

Referring now to FIG. 6 there is illustrated a similar embodiment with the paired wheel type finishing tools being mounted on the rotary flow-through arbor 80 but supported on hubs 82 and 83 having a much larger relative radial extent providing increased space between the paired tools indicated at 84 to accommodate eccentric shafts having greater throw. Again the hubs and tools are mounted in exactly the same way and clamped to each other and to the arbor by the clamp nut 85. Again, fluid flows through the passage 87 in the arbor, through the ports 88, into the hollow interior of the hubs 82 and 83, and radially outwardly between the paired tool sections. It will also be appreciated that the arbor may be provided with a wide variety of porting arrangements which may be plugged and unplugged so that the axial spacing on any given arbor may be varied depending upon the crankshaft or cam shaft being finished.

Test have indicated that the tools on the quick change arbor illustrated may be completely changed out in approximately 25 minutes without using skilled trades, and of course without disturbing the balance of the rotary arbor or shaft.

It can now be seen that there is provided a cost effective quick change system for the complex finishing machines used for finishing the journals of eccentric shafts such as crankshafts or cam shafts. The quick change flow-through arbor provides increased productivity minimizing process and machine down time for the change over. The special drive lugs on the interior of the rings and the interfitting bayonet slots enable the wheel sections quickly to be mounted on the hubs from either side. The lock nut on the end of the arbor permits not only quick removal and replacement, but also provides a positive drive when properly tightened. The illustrated system also provides more effective distribution of coolant or lubricant at the point of tool contact with the work, providing improved quality of finish. Such construction also thus provides longer tool life. The changeover of course may be accomplished without any safety hazards such as welding in an oily environment or creating damage to balanced arbors by breaking or rewelding parts or tools thereto. All of this of course can be accomplished without a skilled welder or his required assistant.

Finally, more importantly, the ease of the change out will ensure that the change outs occur when they should thus maintaining proper finishing consistency and control.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

What is claimed is:

1. A rotary finishing tool comprising an annular ring in which the finishing material is secured and from which said finishing material projects radially outwardly, a drive lug projecting radially inwardly from said annular ring, an adapter hub having an outside diameter only slightly less than the inside diameter of said ring whereby said ring may be closely telescoped over said adapter hub, said adapter hub including a bayonet slot on the circumference thereof adapted to interfit with said lug whereby said ring may be telescoped over said adapter hub with said in lug alignment with said bayonet slot and then rotated with respect to said adapter hub to be properly positioned on said adapter hub and to be driven thereby through the driving engagement between said lug and an end of said slot, said slot being a T-slot with the stem of the T extending axially of the adapter hub and the head of the T extending circumferentially, said lug engaging at either end of the head of the T to provide a drive point between the adapter hub and ring depending on the direction of rotation of the tool, and wherein said adapter hub accommodates two rings side-by-side and has two such head of the T slots circumferentially parallel to each other accommodating the respective lugs of the side-by-side rings.

2. A tool as set forth in claim 1 wherein the T slots are side-by-side with the stems of each T interconnected whereby said slots are in the general form of an H and a ring may be mounted on the adapter hub axially from either end.

3. A tool as set forth in claim 2 including an annular groove on the exterior of said adapter hub between said T-slot heads, and a hollow interior, and ports interconnecting said hollow interior and said annular groove, whereby fluid conveyed to said groove flows radially outwardly between said side-by-side rings.

4. A tool as set forth in claim 3 wherein said rings are channel shaped and include indented sides to facilitate the flow of fluid radially therealong.

5. A tool as set forth in claim 4 wherein said hub is mounted on a hollow shaft for rotation therewith, and radially extending ports in said shaft communicating with the interior of each hub whereby fluid may be conveyed through said shaft to said hub.

6. A tool as set forth in claim 5 including a plurality of hubs and annular rings mounted thereon each spaced along said shaft, each clamped axially to each other and the shaft for rotation therewith.

7. A tool as set forth in claim 6 including spacers between said hubs providing a gap therebetween sufficient to accommodate the throw of a crankshaft or cam shaft.

8. A tool as set forth in claim 7 including discs on each side of each adapter hub whereby there is a disc interposed between each adapter hub and adjoining spacer.

9. A tool as set forth in claim 8 wherein said discs extend radially beyond said hubs and bear against rings when clamped.

10. An eccentric shaft finishing machine comprising a hollow rotatable arbor, adapter hubs mounted on said arbor for rotation therewith and axially spaced therealong, a wheel type finishing tool mounted on each hub, each tool including a ring closely telescoping over the hub, and said ring including at least one inwardly projecting drive lug, and a bayonet slot in the face of the hub whereby said ring may be telescoped over the hub with said rive lug in register with said slot, and then relatively rotated to be mounted on and in driving engagement with said hub, a pair of wheel type finishing tools side-by-side on each hub, each said hub including a hollow interior, radial ports in said arbor communicating with the hollow interior of each arbor, radial ports in each hub between said side-by-side wheel type finishing tools whereby coolant and the like is directed directly at the working face of the tools, and an annular groove in said hub axially between said tools.

11. A machine as set forth in claim 10 wherein said bayonet slot includes an axially extending entrant portion, and a circumferential portion extending in both directions therefrom, whereby said lug may engage either end of said circumferential portion offset from said entrant portion depending upon the direction of rotation.

12. A machine as set forth in claim 11 including diametrically opposite slots and lugs on the face of said hub and interior of said ring respectively.

13. A machine as set forth in claim 10 wherein said rings are U-shape channels, each channel having indented sides to facilitate the flow of coolant radially between said tools.

14. A machine as set forth in claim 10 including spacers between each hub stacked with said hubs on said arbor, and a clamp nut at one end of said arbor clamping said hubs and spacers to each other and the arbor for rotation therewith.

* * * * *